US008658913B2

(12) United States Patent
Hultgreen et al.

(10) Patent No.: US 8,658,913 B2
(45) Date of Patent: Feb. 25, 2014

(54) CONTROL BOX ARRANGEMENT WITH A MOUNTING ELEMENT

(75) Inventors: Jerry Hultgreen, Krusaa (DK); Hans Erik Fogh, Broager (DK)

(73) Assignee: Danfoss A/S, Nordborg (DK)

( * ) Notice: Subject to any disclaimer, the term of this patent is extended or adjusted under 35 U.S.C. 154(b) by 9 days.

(21) Appl. No.: 13/257,117

(22) PCT Filed: Jun. 18, 2009

(86) PCT No.: PCT/DK2009/000145

§ 371 (c)(1),
(2), (4) Date: Dec. 2, 2011

(87) PCT Pub. No.: WO2010/105621

PCT Pub. Date: Sep. 23, 2010

(65) Prior Publication Data

US 2012/0061136 A1 Mar. 15, 2012

(30) Foreign Application Priority Data

Mar. 18, 2009 (DE) ..... 10 2009 013 825

(51) Int. Cl.
*H05K 5/00* (2006.01)

(52) U.S. Cl.
USPC ..... 174/520; 174/500; 174/58; 174/63

(58) Field of Classification Search
USPC ..... 174/520, 500, 60, 63, 58
See application file for complete search history.

(56) References Cited

U.S. PATENT DOCUMENTS 5,223,673 A * 6/1993 Mason ..... 174/53
6,101,819 A 8/2000 Onaka et al.

FOREIGN PATENT DOCUMENTS

| | | | |
|---|---|---|---|
| DE | 23 60 600 | A1 | 6/1975 |
| DE | 41 11 025 | A1 | 10/1992 |
| DE | 20 2007 006 099 | U1 | 1/2008 |
| DE | 10 2007 004 020 | A1 | 7/2008 |
| EP | 0 771 049 | A2 | 5/1997 |
| EP | 1 011 119 | A2 | 6/2000 |
| FR | 2 856 202 | A1 | 12/2004 |
| GB | 2 305 961 | A | 4/1997 |
| JP | 2000-337765 | A | 12/2000 |
| WO | 03/081153 | A1 | 10/2003 |

OTHER PUBLICATIONS

International Search Report for Serial No. PCT/DK2009/000145 dated Mar. 29, 2010.

* cited by examiner

*Primary Examiner* — Dhirubhai R Patel
(74) *Attorney, Agent, or Firm* — McCormick, Paulding & Huber LLP

(57) ABSTRACT

The invention concerns a control box arrangement (1) with a control box (2) and a mounting plate (4) having a front side (18) and a rear side (11) and an opening (5) in which the control box (2) is inserted from the front side (18). It is endeavored to enable simple mounting and dismounting. For this purpose, the control box (2) includes at least one locking bar (7), which rests on the rear side (11) in a mounting position (9), a mounting element (10) being insertable in the control box (2) to displace the locking bar (7) to the mounting position (9).

15 Claims, 2 Drawing Sheets

CONTROL BOX ARRANGEMENT WITH A MOUNTING ELEMENT

CROSS REFERENCE TO RELATED APPLICATIONS

This application is entitled to the benefit of and incorporates by reference essential subject matter disclosed in International Patent Application No. PCT/DK2009/000145 filed on Jun. 18, 2009 and German Patent Application No. 10 2009 013 825.0 filed Mar. 18, 2009.

FIELD OF THE INVENTION

The invention concerns a control box arrangement with a control box and a mounting plate comprising a front side and a rear side and an opening in which the control box is inserted from the front side.

BACKGROUND OF THE INVENTION

Such a control box arrangement is known from WO 03/081153 A1. The known control box arrangement is used in household appliances, like for instance a refrigerator, to adjust refrigerator functions. In the known case, the mounting plate is formed by the front side of the refrigerator door or a plate on the front side of the refrigerator. For the fixing of the control box, a rear side cover is arranged on the rear side of the mounting plate. Subsequently, polyurethane is pumped into the chamber on the rear side, to fix the rear side cover. Then the control box is inserted and fixed by the mounting of the frame in the rear side cover. Such a mounting is expensive and requires a plurality of components. Further, the opening in the mounting plate has a relatively complicated contour. The rear side of the mounting plate must be accessible to permit the mounting of the rear side cover. The dismounting of such an arrangement is just as complicated as the mounting. For example, the polyurethane has to be removed from the chamber again.

SUMMARY OF THE INVENTION

The invention is based on the task of enabling a simple mounting and dismounting of a control box arrangement.

With a control box arrangement as mentioned in the introduction, this task is solved in that the control box comprises at least one locking bar, which rests on the rear side in a mounting position, a mounting element being insertable in the control box to displace the locking bar to the mounting position.

For the mounting and dismounting, merely the access from the front side of the mounting plate is required. Firstly, the control box can be inserted in the opening of the mounting plate. Then, the mounting element is inserted in the control box from the front side, which displaces the locking bar to the mounting position. In this way, the control box is reliably secured in the mounting plate, as the locking bar forms a form fitting with the mounting plate. For this purpose, however, only an access from one side is required. Additional elements, such as screws, nuts and the like will not be required. For the dismounting, the mounting element is led out of the control box again, and the locking bar is no longer held in the mounting position. Now, the control box can simply be taken out of the mounting plate again.

Preferably, the locking bar can be swivelled between a resting position and the mounting position. The locking bar can simply be swivelled by the introduction of the mounting element. Swivelling permits a continuous displacement into the mounting position of the locking bar and can simply be reversed for dismounting. In the resting position of the locking bar, the control box can be inserted in and removed from the mounting plate. In the mounting position, however, the control box is fixed.

Preferably, the locking bar is a polygon. At least at one edge, the polygon can have a rounding. If the locking bar is a polygon, one side of the polygon can be arranged so that the mounting element can interact with this side. An other side of the polygon can be located so that it fixes the mounting plate in the mounting position of the locking bar. Thus, the various sides of the polygon can assume different functions. The mounting element is then unrotatably held in the control box.

Preferably, in a resting position, the locking bar has an acute angle in relation to the mounting plate and points in the direction of a control box centre. If, in a resting position, at least a part of the locking bar has an acute angle in relation to the mounting plate and points in the direction of a control box centre, the locking bar will not be disturbing during the insertion of the control box into the opening. It namely points away from the edge of the opening in the direction of the control box centre.

Preferably, the mounting element is movable in a direction perpendicularly to the mounting plate. If, in the resting position, the locking bar has an acute angle, and if the mounting element is movable in a direction perpendicularly to the mounting plate, the mounting element will engage the locking bar in a particularly efficient manner. In this connection, the locking bar is displaced or swivelled into the mounting position.

Preferably, the mounting element comprises a part, which can be inserted in the control box, and a further part, which is too large to be inserted. The part of the mounting element that can be inserted into the control box displaces the locking bar from the resting into the mounting position. The part of the mounting element that is too large for insertion prevents the mounting element from being inserted too far. It is even possible to make this part far too large, so that the mounting element has a surface that is easy to grasp and to use for the installer. This permits a simple and fast insertion of the mounting element.

Preferably, several mounting elements can be inserted to displace several locking bars to the mounting position. Several locking bars, which are displaced to the mounting position, fix the control box to the mounting plate at different positions. This causes an improved fixing of the control box arrangement, which is also resistible to larger forces.

Two or more mounting elements can be a part of or fixed to a front panel so the front panel and the mounting elements can be mounted in one operation. The mounting elements are then activating several locking bars simultaneous. The front panel in this context is to be understood as any kind of connecting piece to connect two or more mounting elements. Fixing two or more mounting elements to a front panel obviously makes it simpler to fix the control box to the mounting place since it can be done in one operation.

Preferably, the locking bar engages the mounting plate over an edge of the opening. This means that the locking bar engages the front side and the rear side of the mounting plate, and not only the rear side. Thus, the control box is fixed in the mounting plate both in the direction of the front side and in the direction of the rear side. Instead of the locking bar, it may also be provided that an element connected to the locking bar engages the front side of the mounting plate.

Preferably, in the area of an edge the locking bar is arched on the side facing the edge. If a side facing the edge is made to be arched, differently thick mounting plates can be engaged and thus fixed.

Preferably, the control box rests on the front side of the mounting plate, at least in the area of the locking bar. Thus, the control box engages the mounting plate from the front side. It can, for example, extend somewhat over the opening of the mounting plate. An additional measure preventing the control box from loosening in the direction of the rear side is thus not required.

Preferably, in relation to a thickness of the mounting plate between the front side and the rear side, the locking bar has a holding dimension and the thickness of the mounting plate corresponds to the holding dimension ±35%. The embodiment of the locking bar that engages the mounting plate at the edge of the opening also enables the use of differently thick mounting plates. Accordingly, a control box arrangement can be used for different applications.

Preferably, a connecting element of the locking bar has a tolerance equalisation that is up to ±0.5 mm. Accordingly, the dimension of the opening, into which the control box is inserted, can deviate up to ±0.5 mm from a desired size without influencing the mounting of the control box in the mounting plate. The tolerance equalisation also depends on the size of the control box. With smaller control boxes, the absolute tolerances are smaller.

Preferably, the locking bar is made to be projecting on the side facing the control box. This ensures a force or movement ratio, that is, the projection can be used to displace the locking bar a sufficient distance into the chamber on the rear side of the mounting plate.

Preferably, the locking bar is prestressed in the direction of the control box. This means that, when the control box is pulled out of the mounting plate, the locking bar(s) spring(s) back, so that the control box is released from the mounting plate and can be removed without problems.

BRIEF DESCRIPTION OF THE DRAWINGS

In the following, the invention is described on the basis of preferred embodiments in connection with the drawings, showing.

DETAILED DESCRIPTION OF THE PREFERRED EMBODIMENTS

Figure 1:
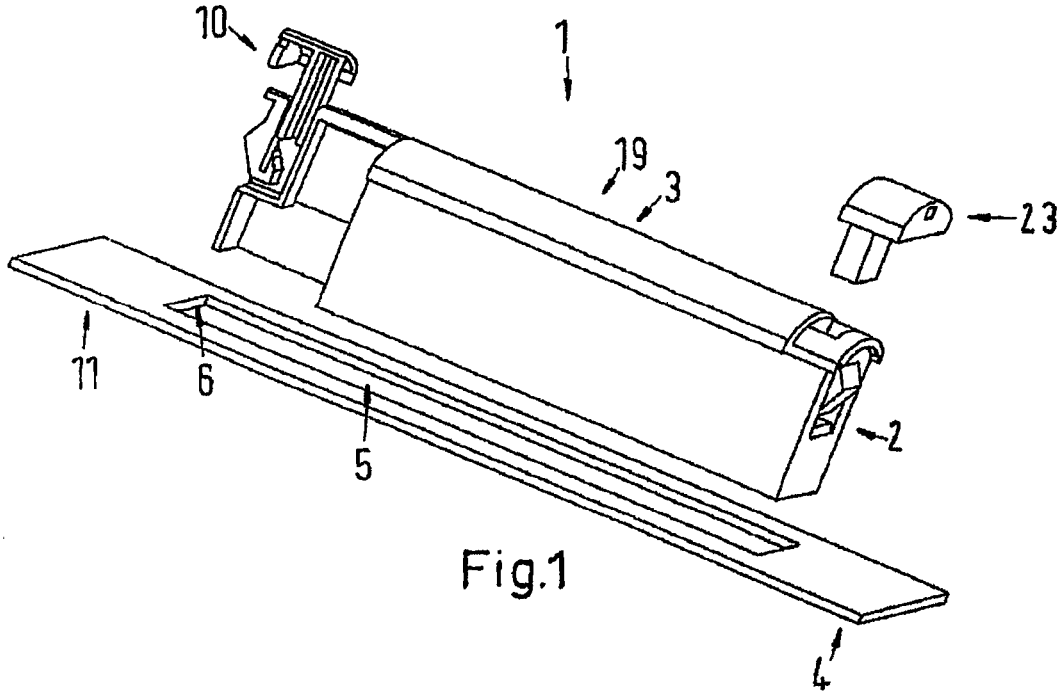
FIG. 1 is a perspective view of a first embodiment of a control box arrangement.
Figure 2:
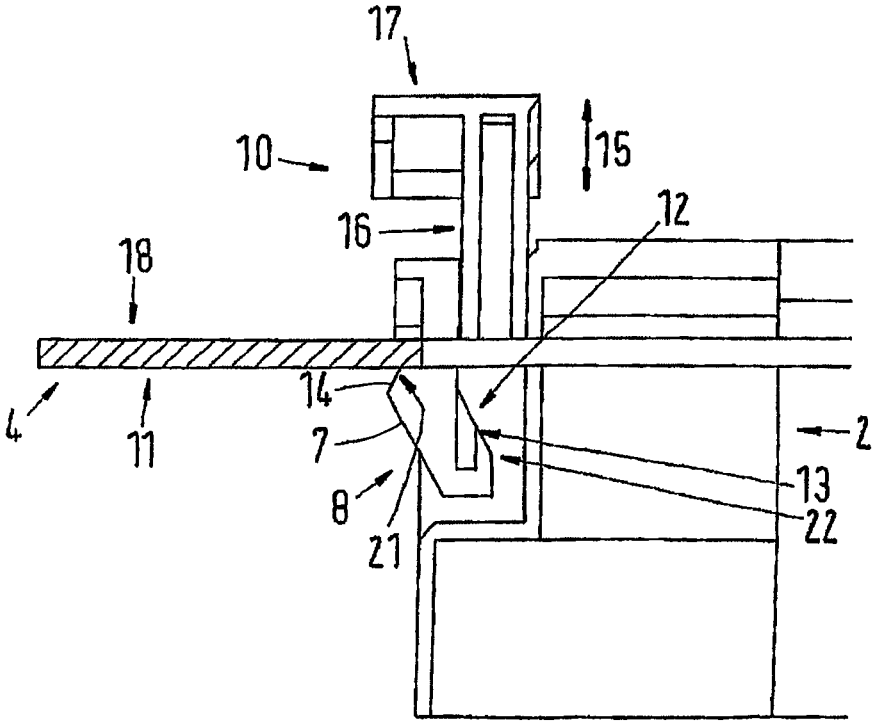
FIG. 2 is a sectional view of the control box arrangement with a locking bar in the resting position.
Figure 3:
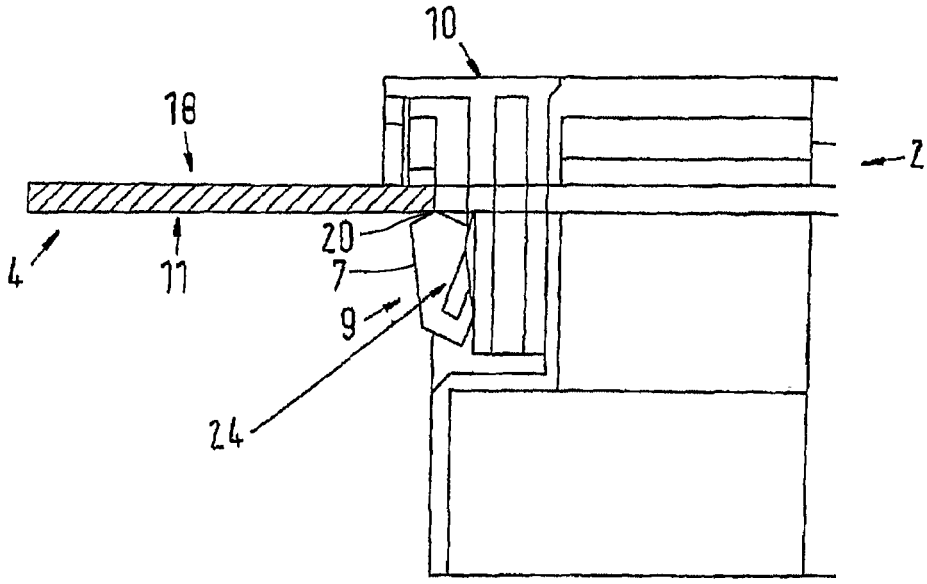
FIG. 3 is a sectional view of the control box arrangement with the locking bar in the mounting position.

A control box arrangement 1 comprises a control box 2, which is provided with a cover 3. The cover 3 can, for example, be transparent and be fixed on the control box 2 by terminals, not shown in detail, or in a different manner.

Such a control box can, for example, be arranged on a refrigerator. For this purpose, the control box 2 can comprise control electronics and a display for the refrigerator, which are visible, if the cover 3 is transparent. Further, the control box 2 can contain operating elements, for example in the form of keys or the like, which can be activated through the transparent cover 3. For reasons of clarity, a cable connecting the control box 2 to other elements of the refrigerator is not shown.

The control box 2 is to be mounted in a mounting plate 4. The mounting plate 4, for example, forms the front side of a refrigerator door or the front side of a refrigerator housing. Therefore, the mounting plate 4 can also be called "chassis".

For the adoption of the control box 2, the mounting plate 4 has an opening 5. The opening 5 is surrounded by an edge 6. The opening can have a simple square shape or another shape adapted to the control box 2. Otherwise, a working of the mounting plate 4 is not required.

Firstly, the control box 2 is inserted in the opening 5. At the control box 2 itself, one or more locking bars 7 are arranged, by means of which the control box 2 can be fixed on the mounting plate 4. For this purpose, the locking bar(s) 7 has/have a resting position 8 and a mounting position 9. In the resting position 8, the control box 2 can be led in and out of the mounting plate 4 without problems. In the mounting position 9, however, the control box 2 is fixed on the mounting plate 4. A mounting element 10 displaces the locking bar 7 between the resting position 8 and the mounting position 9. In the mounting position 9, the locking bar rests on a rear side 11 of the control box 2. In this connection, the mounting element 10 can be led into the control box 2, namely via a recess 12 that can also be made as an opening. When inserted in the control box 2, the mounting element 10 can be fixed therein. For this purpose, a fixing hole 23 can be located on the mounting element 10. A snap element, not shown for reasons of clarity, can engage the fixing hole 23, so that the mounting element 10 is held at the control box 2.

If a dismounting of the control box 2 is desired, the mounting element 10 simply has to be guided out of the control box 2 again. The locking bar 7 is then displaced from the mounting position 9 to the resting position 8 again. In this state, the control box 2 can be guided out of the opening 5 again.

In this connection, the locking bar will be made to be able to swivel between the resting position 8 and the mounting position 9. This enables a reversible shifting between the two positions. Additionally, a swivelling permits that also with different thicknesses of the mounting plate 4 the locking bar 7 will always rest on the rear side 11 of the mounting plate 4. Expediently, for this purpose, the locking bar 7 will be made as a polygon. With the polygon, various functions can be assumed by different sides. Thus, for example, on polygon side 13 can interact with the mounting element 10, so that it swivels the locking bar 7 from the resting position 8 into the mounting position 9. A further polygon side 14 can serve the purpose of fixing the control box 2 to the mounting plate 4. In the resting position 8, the locking bar 7 will be arranged so that an acute angle is provided between the mounting plate 4 and the locking bar 7. Further, the locking bar 7 will be arranged to point in the direction of a control box centre. When the control box 2 is inserted into the opening, the locking bar 7 will thus not interfere. Further, the mounting element 10 will be made to be movable in a direction 15, which is perpendicular to the mounting plate. If the mounting element 10 meets the locking bar 7, which has, in the resting position 8, an acute angle in relation to the mounting plate 4, the locking bar 7 will be engaged particularly efficiently. In this connection, only a part 16 of the mounting element 10 can be inserted into the control box 2. This part 16 interacts with the locking bar 7. An additional part 17 is too large to be inserted. However, this part can be grasped and operated particularly well by the installer. Further, the additional part 17 prevents the mounting element 10 from being inserted too far into the control box 2.

In the ideal case, several mounting elements 10 and several locking bars 7 will be provided to increase the stability of the connection of the control box 2 and the mounting plate 4.

In order to ensure a safe hold, the locking bar will not only engage the rear side 11, but also the front side 18, of the mounting plate 4. The additional polygon side 14 of the locking bar 7 can be made straight, meaning that in the mounting position 9 the additional polygon side 14 will bend around the mounting plate 4. If the mounting plate 4 has a uniform thickness, the additional polygon side 14 will bend around a specific point. If, however, the mounting plate 4 has a different thickness or is thicker all over, this point will be somewhat displaced. However, the locking bar 7 can also be arched in an area 21 of the additional polygon side 14, which the mounting plate 4 engages, when the locking bar 7 has been moved through the control box 2 into a chamber at the rear side 11 of the mounting plate 4. The arch will enable the locking bar 7 to engage differently thick mounting plates 4. For reasons of clarity, the arch is not shown in the drawing.

The locking bar 7 is, for example, provided for a certain thickness of the mounting plate 4, in the following called the holding dimension. However, the locking bar 7 can also provide a sufficiently firm connection between the control box 2 and the mounting plate 4, if the thickness of the plate is up to 35% smaller or larger than this holding dimension.

Via a connecting element 20 the locking bars 7 can be connected to the control box 2. If the connecting elements 20 have a certain flexibility, the opening 5 does not have to be manufactured with a very high accuracy. Both the length and the width of the opening 5 may have a tolerance in the order of up to ±0.5 mm, depending on the size of the control box.

The control box 2 can be made so that at least in the area of the locking bar 7 it rests on the front side 18 of the mounting plate 4. Thus, it is not possible to loosen the control box 2 in the direction of the rear side 11. A projection is provided on the side 22 of the locking bar 7 facing the control box 2. The projection can be used to displace the locking bar a sufficient distance into the chamber on the rear side 11 of the mounting plate 4. For reasons of clarity, the projection is not shown in the drawing. The locking bar 7 is prestressed in the direction of the control box 2. If the mounting element 10 is removed, the locking bar will swivel on its own from the mounting position 9 to the resting position 8. If the locking bar 7 has been "jammed", that is, it does not automatically return to the resting position 8, it can be pushed back. For this purpose, an object, for example a screwdriver, can be inserted in a gap 24 of the locking bar 7 to push the locking bar back.

Figure 4:
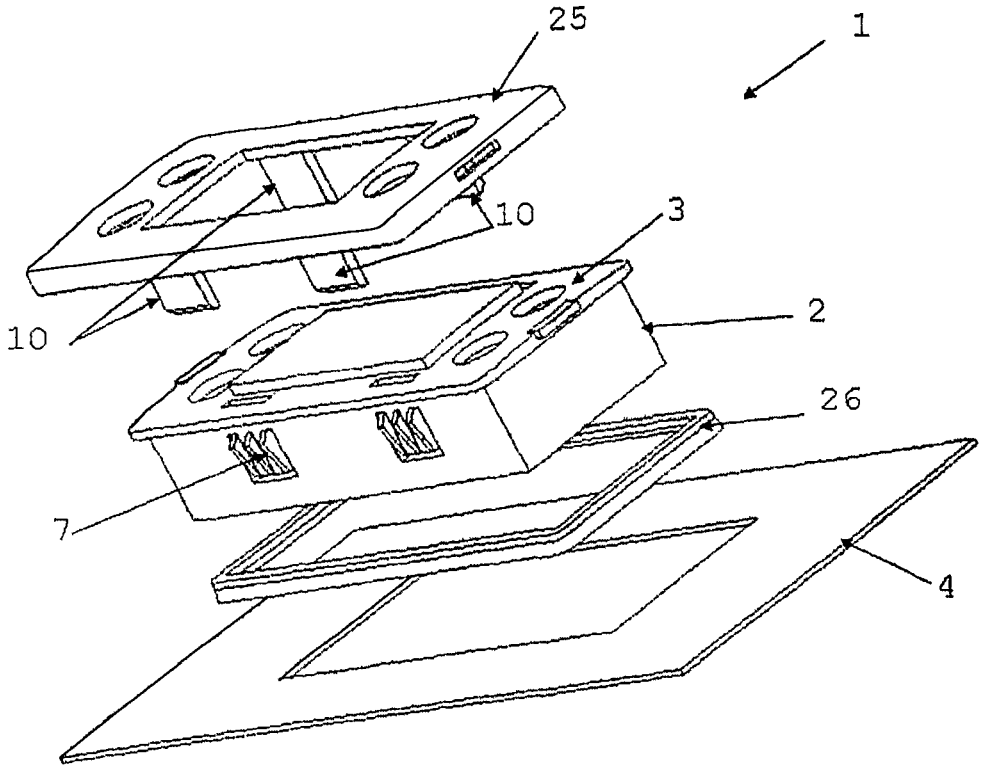
FIG. 4 shows an embodiment where several mounting elements are part of a front panel.

FIG. 4 shows an embodiment where the mounting elements 10 are part of or are fixed to a front panel 25. The front panel is an extra panel that is placed on top of the cover 3. The purpose of the front panel 25 is to add a special design to the box and/or to add text explaining for instance the functionality of the buttons. Further the mounting elements 10 can be part of the front panel 25 or fixed to the front panel 25 so all locking bars 7 can be activated by the mounting elements 10 simultaneous in one operation. In FIG. 4 there also is a rubber gasket 26, the rubber gasket 26 is placed between the mounting plate 4 and the control box 2 to ensure a water tight fixture. The locking bars 7 in FIG. 4 are in another form than in the other figures, here the locking bars are divided in three parts but the functionality of course is the same.

Although the invention above has been described in connection with preferred embodiments of the invention, it will be evident for a person skilled in the art that several modifications are conceivable without departing from the invention as defined by the following claims.

What is clamed is:

1. A control box arrangement comprising a control box, a mounting element and a mounting plate comprising a front side and a rear side and an opening in which the control box is inserted from the front side, wherein the control box comprises at least one locking bar formed on an outer wall of the control box, the at least one locking bar resting on the rear side of the mounting plate when in a mounting position, the mounting element being part of or fixed to a front panel and insertable in the control box to displace the locking bar to the mounting position, and wherein insertion of the control box comprises the control box being inserted from the front into the opening of the mounting plate, and said insertion comprising the at least one locking bar, by means of the control box, being fixed on the mounting plate, and said insertion comprising the control box capable of being led in and out of the mounting plate, when the at least one locking bar is in a resting position, and said insertion comprising the control box being fixed on the mounting plate, when the at least one locking bar is in the mounting position, and said insertion comprising the mounting element displacing the at least one locking bar between the resting position and the mounting position.

2. The control box arrangement according to claim 1, wherein the locking bar can be swivelled between a resting position and the mounting position.

3. The control box arrangement according to claim 1, wherein the locking bar is a polygon.

4. The control box arrangement according to claim 1, wherein in a resting position, the locking bar has an acute angle in relation to the mounting plate and points in the direction of a control box centre.

5. The control box arrangement according to claim 1, wherein the mounting element is movable in a direction perpendicularly to the mounting plate.

6. The control box arrangement according to claim 1, wherein the mounting element comprises a part, which can be inserted in the control box, and a further part, which is too large to be inserted.

7. The control box arrangement according to claim 1, wherein several mounting elements can be inserted to displace several locking bars to the mounting position.

8. The control box arrangement according to claim 7, wherein two or more mounting elements are part of or fixed to the front panel.

9. The control box arrangement according to claim 1, wherein the locking bar engages the mounting plate over an edge of the opening.

10. The control box arrangement according to claim 1, wherein in the area of an edge the locking bar is arched on the side facing the edge.

11. The control box arrangement according to claim 1, wherein the control box rests on the front side of the mounting plate, at least in the area of the locking bar.

12. The control box arrangement according to claim 1, wherein in relation to a thickness of the mounting plate between the front side and the rear side, the locking bar has a holding dimension, the thickness of the mounting plate corresponding to the holding dimension ±35%.

13. The control box arrangement according to claim 1, wherein a connecting element of the locking bar has a tolerance equalisation that is up to ±0.5 mm.

14. The control box arrangement according to claim 1, wherein the locking bar is made to be projecting on the side facing the control box.

15. The control box arrangement according to claim 1, wherein the locking bar is prestressed in the direction of the control box.

* * * * *